US012729487B2

(12) United States Patent
Bednarczyk et al.

(10) Patent No.: US 12,729,487 B2
(45) Date of Patent: Sep. 8, 2026

(54) BRIDGE FOR A RAIL VEHICLE AND METHOD FOR ASSEMBLING A BRIDGE BEAM ON SUCH A BRIDGE

(71) Applicant: Vossloh Fastening Systems GmbH, Werdohl (DE)

(72) Inventors: Adrian Bednarczyk, Lüdenscheid (DE); Winfried Bösterling, Neuenrade (DE)

(73) Assignee: Vossloh Fastening Systems GmbH, Werdohl (DE)

( * ) Notice: Subject to any disclaimer, the term of this patent is extended or adjusted under 35 U.S.C. 154(b) by 694 days.

(21) Appl. No.: 18/018,378

(22) PCT Filed: Jul. 27, 2021

(86) PCT No.: PCT/EP2021/071059
§ 371 (c)(1),
(2) Date: Jan. 27, 2023

(87) PCT Pub. No.: WO2022/023373
PCT Pub. Date: Feb. 3, 2022

(65) Prior Publication Data

US 2023/0323608 A1 Oct. 12, 2023

(30) Foreign Application Priority Data

Jul. 28, 2020 (DE) ..... 10 2020 119 905.8

(51) Int. Cl.
*E01B 3/44* (2006.01)
*E01B 2/00* (2006.01)
*E01D 19/12* (2006.01)

(52) U.S. Cl.
CPC ..... *E01B 2/003* (2013.01); *E01B 3/44* (2013.01); *E01D 19/12* (2013.01)

(58) Field of Classification Search
CPC ..... E01B 2/003; E01B 3/44; E01D 19/12
See application file for complete search history.

(56) References Cited

U.S. PATENT DOCUMENTS 4,687,134 A 8/1987 Burwell
10,774,477 B2 9/2020 Bösterling et al.
(Continued)

FOREIGN PATENT DOCUMENTS

DE 4328185 C1 12/1994
DE 19813258 C1 * 5/1999 ..... E01B 3/16
(Continued)

*Primary Examiner* — Abigail A Risic
(74) *Attorney, Agent, or Firm* — The Webb Law Firm

(57) ABSTRACT

A bridge for a rail vehicle, including a track, which is formed from two parallel rails for being driven on by the rail vehicle, and including a bridge beam, which supports the rails of the track and is aligned transversely to a support profile of the bridge. The bridge beam is supported by a height adjustment element arranged between the support profile and the bridge beam, and the position of the bridge beam is fixed in relation to the height adjustment element by at least one fastening device. Exact positioning of the bridge beams at their target height is achieved by designing the height adjustment element as a single-piece block, whose height is adapted to the distance between the support profile and the bridge beam via material-removing processing. Preferably, the bridge beam and the height adjustment element consist of a plastic-based material, in particular a plastic-sand mixture.

16 Claims, 2 Drawing Sheets

(56) References Cited

U.S. PATENT DOCUMENTS

| | | | |
|---|---|---|---|
| 11,396,728 | B2 | 7/2022 | Bösterling et al. |
| 2019/0118424 | A1 | 4/2019 | Bösterling et al. |
| 2019/0119859 | A1 | 4/2019 | Bosterling et al. |

FOREIGN PATENT DOCUMENTS

| | | | |
|---|---|---|---|
| DE | 202011050077 | U1 | 7/2011 |
| EP | 3445734 | B1 | 2/2019 |
| JP | H04265301 | A | 9/1992 |
| JP | H4265301 | A | 9/1992 |
| JP | 2000230201 | A | 8/2000 |
| KR | 1020110066060 | A | 6/2011 |
| KR | 1020180123707 | A | 11/2018 |
| WO | 2018192928 | A1 | 10/2018 |
| WO | 2018192930 | A1 | 10/2018 |

* cited by examiner

BRIDGE FOR A RAIL VEHICLE AND METHOD FOR ASSEMBLING A BRIDGE BEAM ON SUCH A BRIDGE

CROSS-REFERENCE TO RELATED APPLICATIONS

This application is the United States national phase of International Application No. PCT/EP2021/071059 filed Jul. 27, 2021, and claims priority to German Patent Application No. 10 2020 119 905.8 filed Jul. 28, 2020, the disclosures of which are hereby incorporated by reference in their entireties.

BACKGROUND OF THE INVENTION

Field of the Invention

The invention relates to a bridge for a rail vehicle, comprising a track, which is formed from two parallel rails and is provided for being driven on by the rail vehicle, and comprising a bridge beam, which supports the rails of the track and is aligned transversely to a support profile of the bridge, wherein the bridge beam is supported by a height adjustment element arranged between the support profile and the bridge beam and wherein at least one fastening device is provided by means of which the position of the bridge beam is fixed in relation to the height adjustment element.

Description of Related Art

In addition, the invention relates to a method for assembling a bridge beam on a support profile of a bridge for a rail vehicle, provided that the upper side of the bridge beam is at a certain absolute target height when fully assembled.

Rails of tracks for rail vehicles are usually fastened on sleepers which are aligned transversely to the longitudinal direction of the rails and are supported in the ballast bed or on a solid surface. Such sleepers usually consist of wood, plastic, concrete or steel.

Since, in the case of bridges which are composed of steel profiles, the components, which support the respective track and which correspond in their function smoothly with the sleepers commonly used in the track superstructure, are referred to as "bridge beams" because, unlike the sleepers which are usually supported over their entire length, they freely bridge the distance between two support profiles which take the weight of the track and the rail vehicle travelling over them.

It goes without saying that it is also important for ensuring the correct movability of tracks in the field of bridges that the running surface of the rails of the tracks, on which the wheels of the rail vehicle roll, is uniform in the vertical direction. Accordingly, especially in the field of bridges composed of steel profiles, there are strict requirements for the exact height position of the contact surfaces provided on the upper side of the bridge beams on which the rail is supported during use.

However, as with the sleepers, bridge beams are also subject to a certain amount of wear. For this reason, the bridge beams must be replaced at certain intervals, which can be up to 20 years. However, since not only the bridge beams themselves are subject to wear, but also the bridge as a whole, its support profiles or the components supporting the support profiles can deform over such a long service life, each individual bridge beam, which is present on the bridge and must be replaced, must be measured for the replacement process in order to determine its respective actual condition.

Based on the actual condition recorded on the construction site, an available beam blank, usually consisting of pre-treated wood, is then processed so as to remove material in such manner that its dimensions are precisely adapted to the target dimensions of the beam to be replaced such that the replacement beam can be placed at the point of the beam to be replaced and an optimal horizontal alignment of the rails supported by the beam is ensured.

Experience here shows that only by individually examining and adapting each individual bridge beam in this way for settling processes, unevenness and special local conditions, such as rivets, can the horizontality of the bridge be reliably compensated. The beam blank is usually processed on the construction site because experience has also shown that only in this way can measurement errors or fitting inaccuracies determined on site at the time of assembly be taken into account in a targeted manner during processing and duplicate effort can therefore be avoided, which would otherwise be necessary for pre-processing in the production plant and for often unavoidable post-processing on the construction site.

In DE 198 13 258 C1, the use of bridge beams designed as a double T-steel profile has been proposed as an alternative to the use of bridge beams consisting of wood. The fastening of such a bridge beam to the respective support of the bridge, also designed as a double T-profile, takes place via a stop bar arranged on the upper flange of the support and running parallel to the bridge beam and via which the horizontal position of the bridge beam is fixed by means of suitable fastening means. At the same time, further fastening means are provided which serve to fix the bridge beam in the vertical direction on the support. The distance between the bridge beam and the support profile can be adjusted by one or a plurality of plates, which, if necessary, are arranged as stacks between the bridge beam and the support profile and which protrude laterally at least beyond the lower flange of the bridge beam or the upper flange of the support profile. The bridge beam is then fixed to the support profile by means of tensioning screws, which, in a suitable manner, tension the lower flange of the bridge beam against the upper flange of the support profile and thus fix the bridge beam in the horizontal longitudinal direction of the support profile as well as in the vertical height direction of the support profile on the support profile.

Although the use of plates assembled into a stack proposed in the prior art explained above allows for a comparably simple adjustment of the height alignment of the bridge beams, the fine gradation of the height adjustment often required in practice proves to be difficult under the harsh working conditions present in practice.

SUMMARY OF THE INVENTION

Based on the prior art explained above, the object has therefore been to indicate a bridge for a rail vehicle in which an exact positioning of the bridge beams at their target height can be achieved with reduced effort and at low costs.

A method will also be indicated for enabling the assembly of bridge beams on a bridge for rail vehicles in a simplified manner and in the target position.

The invention has achieved this object through a bridge which has at least the features as described herein and a method which comprises at least the work steps as described herein.

It goes without saying that a person skilled in the art supplements those features or work steps not explicitly mentioned in the present case in the practical implementation of the invention and its variants and extension options explained here, which they know from their practical experience and which are regularly used in the manufacture or maintenance of bridges of the type in question here or in the performance of methods of the type in question here.

Advantageous configurations of the invention are defined in the dependent claims and, like the general concept of the invention, are explained in detail in the following.

A bridge according to the invention for a rail vehicle thus comprises, in accordance with the prior art explained at the outset, a track, which is formed from two parallel rails and which is provided for being driven on by the rail vehicle, and at least one bridge beam, which supports the rails of the track and is aligned transversely to a support profile of the bridge, wherein the bridge beam is supported by a height adjustment element arranged between the support profile and the bridge beam and wherein at least one fastening device is provided by means of which the position of the bridge beam is fixed in relation to the height adjustment element.

According to the invention, in the case of such a bridge, the height adjustment element is now designed as a single-piece block, whose height is adapted to the distance between the support profile and the bridge beam by means of material-removing processing.

The invention is therefore based on the idea of supporting a completely formed bridge beam, which is no longer processed on the construction site, on the support profile via a height adjustment element formed in one piece in a block shape. The block used for height adjustment according to the invention is thereby adapted in terms of its height by means of material-removing processing such that the bridge beam with its upper side, on which the rail to be supported is located, is in the vertical target position (target height) intended for it. This target position corresponds to the "absolute target height", which must be complied with such that the running surface of the rail fastened to the respective bridge beam is at the optimal height for being travelled over in problem-free and safe manner by a rail vehicle.

In contrast to the prior art, which is explained above and which is based on a bridge beam consisting of steel, in the case of an assembly of the bridge beam according to the invention, individual plates, which must be cumbersomely put together and fastened in order to carry out the height adjustment, are no longer required. Rather, a height adjustment element provided according to the invention is a compact fixed block, which, unlike the large-volume beam blanks provided in the prior art, is easy to handle and can be easily brought to the required height with the material processing techniques proven in practice when processing bridge beams on the construction site.

Accordingly, the invention envisages, for the assembly of a bridge beam on a support profile of a bridge for a rail vehicle, provided that the upper side of the bridge beam is at a certain absolute target height when fully assembled, at least the following work steps:

a) providing a bridge beam;
b) providing a height adjustment element, manufactured as a single-piece block and having a height greater than a theoretically determined, maximum possible distance, which exists between the underside of the bridge beam and the upper side of the support profile when the upper side of the bridge beam is at the target height;
c) determining the actual distance present between the underside of the bridge beam and the upper side of the support profile when the upper side of the bridge beam is at the target height;
d) shortening the height of the height adjustment element effective in the assembly position between the underside of the bridge beam and the upper side of the support profile by the difference determined in work step c) by processing the height adjustment element so as to remove material;
e) placing the height adjustment element, which is adapted in terms of its height, on the upper side of the support profile;
f) placing the bridge beam on the height adjustment element;
g) fixing the bridge beam to the height adjustment element.

The support profile of a bridge according to the invention is typically designed as a T-beam with an upper flange and a web supporting the upper flange or as a double T-beam in which, in addition to the upper flange, a lower flange is also formed on the web on its side facing away from the upper flange. However, other profile shapes are also conceivable, such as a box shape with a rectangular cross-section. It is only essential for the invention here that the support profile provides, on its upper side, a surface on which the height adjustment element provided according to the invention can sit.

The material-removing processing of the height adjustment element carried out according to the invention for the purpose of adapting the height can be carried out in any suitable manner known to the person skilled in the art and adapted to the material of the height adjustment element as usual for the person skilled in the art. The known machining processes, such as milling, planing, grinding and filing, are suitable for this purpose, which can also be easily carried out in mobile operation on the construction site with the equipment available in practice for this purpose.

In principle, it is conceivable that the bridge beam provided according to the invention is formed in a conventional manner from wood or steel, since the bridge beam no longer needs to be processed at the site of assembly. Likewise, the height adjustment element can consist of any material that allows material-removing processing for the purpose of adapting the height by means of the usual technical measures such as milling, planing, grinding, filing. For example, the height adjustment element can also consist of wood if it has a sufficient load-bearing capacity.

It has proven to be particularly advantageous for the invention if the bridge beam and the height adjustment element are each manufactured from a plastic-based material. The use of a plastic-based material not only has advantages in terms of the durability and load-bearing capacity of bridge beams and height adjustment elements, but also enables, in a simple manner, optimised shaping and adaptation of the bridge beam and of the height element to the spatial conditions and functional requirements existing on site.

In particular, plastic-sand mixtures have proven themselves effective for the manufacture of the bridge beam and/or the height adjustment element, as they are successfully used in the prior art for the production of sleepers for the track superstructure.

Practical experience shows here that for the manufacture of the bridge beam, a plastic material is particularly suitable, which consists of 10-65% by mass, in particular 10-60% by mass, of thermally deformable plastic and as the remainder of sand mixed with the plastic. Variants of this plastic-based material proven effective for the manufacture of sleepers for the track superstructure and the method steps and parameters to be taken into account when processing them into sleepers and bridge beams are described in detail in the European patent 3 445 734 (application number 16 71 76 67.6), the content of which is incorporated into this application by reference. Further configurations of the manner of design and manufacture of a sleeper, which is described in the aforementioned European patent 3 445 734 and which can be applied in the same manner to the manufacture of a bridge beam provided in a bridge according to the invention, are described in WO 2018/192930 A1, the content of which is also incorporated into this application by reference.

The height adjustment element used according to the invention can also be manufactured from a plastic-sand mixture, wherein proportions of up to 65% by mass, in particular up to 60% by mass, sand and 35-100% by mass, in particular 40-100% by mass, plastic, have proven themselves effective. Sand is only added as an option for the material used for the height adjustment element in order to save weight or plastic material. In this case, it has proven to be particularly advantageous in terms of problem-free processing on the construction site if the sand content of the material of the height adjustment element is lower than the sand content of the material of which the bridge beam consists. For example, limiting the sand content to at most 35% by mass or at most 20% by mass has proven effective here. The processing of the plastic-sand mixture composed in this way and the selection of the suitable plastic and sand can also be based on the prior art, which is described in the aforementioned publications EP 3 445 734 B1 and WO 2018/192930 A1 incorporated by reference into this document.

A further advantage of the use of a block-like height adjustment element according to the invention is that it can be mounted on the support profile so as to be displaceable in the longitudinal direction of the support profile due to its high dimensional stability. Due to the displaceability in the longitudinal direction of the support profile and thus in the longitudinal direction of the track, the bridge beam can follow the longitudinal expansion of the rail supported by it, which can occur as a result of changes in temperature, for example. Stresses on the height element due to tensions that can occur when the height element is fixedly fastened to the support profile can thus be reliably avoided.

In this case, the height adjustment element can be used not only as a loose support on the support profile, but also for targeted guidance of the bridge beam connected to the height adjustment element along the support profile in its longitudinal direction. This is possible due to its particular wear resistance and stability, in particular if at least the height adjustment element is formed from plastic-based material.

For the longitudinal guidance, a groove-like depression extending in the longitudinal direction of the support profile can for example be formed into the underside of the height adjustment element assigned to the support profile, the width of said depression measured transversely to the longitudinal extension of the support profile and the depth of said depression measured perpendicular to the upper side of the support profile being dimensioned such that the height adjustment element can be freely displaced on the support profile. At the same time, the wall sections delimiting the depression on their longitudinal sides guide the height adjustment element on the associated longitudinal sides of the support profile such that an unintentional displacement transverse to the longitudinal direction of the support profile is reliably prevented despite the longitudinal displaceability.

Similarly, the guide can also be formed by separately prefabricated guide elements which are fastened to the longitudinal sides of the height adjustment element and which protrude beyond the underside of the height adjustment element and act against the respectively assigned longitudinal side of the support profile.

Due to its robustness and compact form, the height adjustment element provided according to the invention can generally be fixed to the bridge beam in any manner known to the person skilled in the art. The fastening device used for this purpose can for example comprise a first counter bearing provided on the height adjustment element, a second counter bearing provided on the bridge beam and a tensioning means which braces the counter bearings against one another.

A particularly space-saving and at the same time easy-to-assemble configuration results when the counter bearing provided on the height adjustment element is formed by an outer surface of the height adjustment element, on which a recess running through the height adjustment element opens, through which the tensioning means is guided to the counter bearing of the bridge beam. The recess can be designed as a through-opening through which a screw is inserted as a tensioning means, which screw is supported with its head on the edge of the outer surface of the height adjustment element which surrounds the outlet of the through-opening and which serves as a counter bearing. Alternatively, it is also possible to form the counter bearing provided on the height adjustment element by an outer surface of an intermediate piece held on the height adjustment element, on which a recess running through the height adjustment element opens, through which the tensioning means is guided to the counter bearing of the bridge beam. The intermediate piece can be made as an angle element of a higher-strength material. The use of such an intermediate piece not only enables a particularly high load-bearing fastening, but also the compensation of positional inaccuracies and the like. For this purpose, for example, the recess provided on the intermediate piece can be designed as an elongated slot or the like, via which it is possible to position the tensioning means such that it can reliably act on both counter bearings for tensioning purposes even if the counter bearings of the height adjustment element and bridge beam do not align perfectly.

According to a configuration which is particularly advantageous in practice, the bridge beam is mounted on the height adjustment element so as to be displaceable in a vertical direction, i.e. direction of gravity. This can be achieved particularly easily by using an intermediate piece for connecting the height adjustment element to the bridge beam. A vertically displaceable mounting allows the bridge beam to follow the wave-like depressions and elevations of the track running along the track, which occur when the track is driven over by a rail vehicle. Such a vertically movable guide thus also helps to reduce the stresses that would otherwise occur in the region of the fastening of the height adjustment element to the bridge beam or the support profile in the case of a fixed connection.

For the vertical displaceability of the intermediate piece, a guide in the form of a groove-shaped depression extending in the direction of movement can for example be provided on the height adjustment element. Similarly, a connecting member extending in the direction of gravity can also be provided on the intermediate piece, into which connecting member a guide projection provided on the height adjustment element engages, or vice versa.

The counter bearing of the bridge beam serving to connect to the height adjustment element can be formed by a recess designed on the bridge beam into which recess the tensioning means engages. In order to ensure maximum load-bearing capacity, the recess can be formed by a retaining element cast into the bridge beam, which consists, at least in the region against which the tensioning means acts, of a material which is more highly loadable than the material of which the bridge beam consists.

This retaining element can be a hollow profile which has an opening directed towards an outer side of the bridge beam into which opening the tensioning means engages. In this way, a large-area support of the tensioning means can be achieved on the counter bearing, which in this case is formed by the edge region of the retaining element which surrounds the opening and which is gripped by the tensioning means. At the same time, the opening of the retaining element can be designed such that positional inaccuracies can be easily compensated when fastening the height adjustment element to the bridge beam. In particular, retaining elements are suitable for this purpose which have an opening designed as a slot opening extending in the longitudinal direction of the bridge beam, within which opening the tensioning element can be displaced with its bearing section engaging into the opening. In principle, it is conceivable that the opening of the retaining element is provided, for example, on the side surfaces of the bridge beam. For example as a tensioning means, a component designed in the manner of a tension or clasp can then be used, which engages with its end into the relevant opening. However, a particularly simple and at the same time space-saving assembly results if the opening of the retaining element is arranged on the underside of the bridge beam assigned to the support profile.

BRIEF DESCRIPTION OF THE DRAWINGS

The invention is explained in more detail below on the basis of a drawing representing an exemplary embodiment. The schematic drawings show the following.

DESCRIPTION OF THE INVENTION

Figure 2:
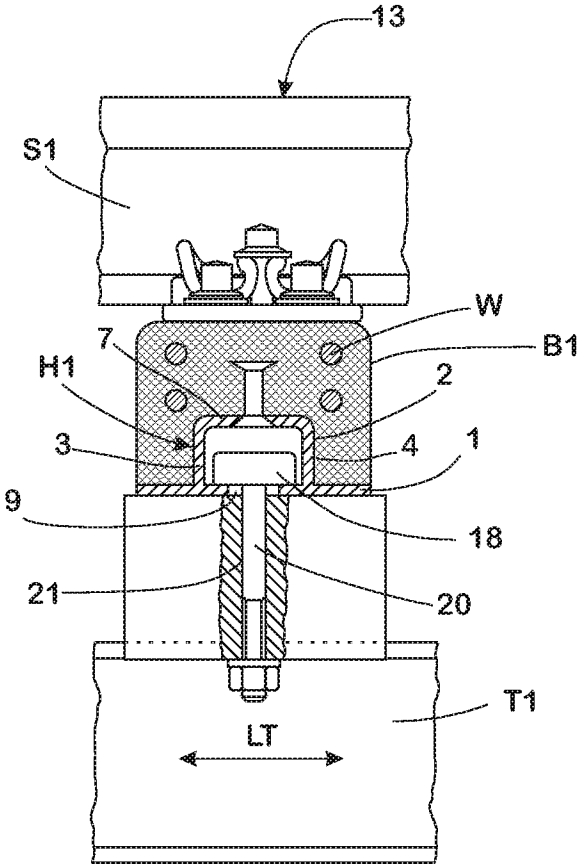
FIG. 2 the fastening according to FIG. 1 in a lateral view sectioned partially along the section line A-A drawn in FIG. 1.

The support profiles T1, T2, which are shown in the figures and formed in a conventional manner as double T-profiles from a steel proven effective for this purpose, are part of an equally conventional bridge, not shown here further, via which a rail vehicle can cross a valley, a river or the like.

A bridge beam B1, B2 is in each case supported on the support profile T1, T2 and is aligned transversely to the longitudinal extension LT of the support profiles T1, T2. A rail S1, S2 is fastened to the upper side of the bridge beams B1, B2 in each case by means of a fastening system proven effective in practice for this purpose. The rail S1, S2 is in each case part of a track not shown here in more detail, which in a known manner comprises in each case two rails guided parallel and fastened, in the same manner as the rails S1, S2, on the bridge beams B1, B2.

The bridge beams B1, B2 each consist of a plastic-sand mixture which has been processed into the respective bridge beam B1, B2 in the manner explained above and described in the European patent 3 445 734 (application number 16 71 76 67.6). The bridge beams B1, B2 are thereby reinforced with steel reinforcements W in the manner described in WO 2018/192930 A1.

During their manufacture, a retaining element H1, H2 formed from sheet steel was additionally cast into the bridge beams B1, B2.

The retaining elements H1, H2 each consist of a base plate 1 covering the bridge beams B1, B2 on their underside U1, U2 and a profile 2 with a U-shaped cross-section (FIGS. 2, 4), which sits with its limbs 3, 4 on the side of the base plate 1 assigned to the interior of the respective bridge beam B1, B2 and is welded there to the base plate 1.

The profile 2 closed on its narrow sides 5 is arranged centrally on the base plate 1 in relation to the width BB of the bridge beams B1, B2 and extends in the longitudinal direction LB of the respective bridge beam B1, B2. The length of the profile 2 is thereby shorter than the length of the respective bridge beam B1, B2 such that the profile 2 is completely surrounded by the material of the respective bridge beam B1, B2 up to its open side assigned to the base plate 1. The respective retaining element H1, H2 formed from the profile 2 and the base plate 1 is anchored in the respective bridge beam B1, B2 in a highly loadable manner by anchors 6, which engage into the material of the respective bridge beam B1, B2 proceeding from the roof 7 of the profile 2 extending between the limbs 3, 4.

The space 8 surrounded by the profile 2 with the base plate 1 is opened to the underside U1, U2 of the respective bridge beam B1, B2 through a slot opening 9 which is aligned centrally in relation to the width BB of the respective bridge beam B1, B2 and extends in the longitudinal direction LB of the respective bridge beam B1, B2.

The bridge beams B1, B2 are each supported by a height adjustment element R1, R2 on the flat upper side 10 of the upper flange of the assigned support profile T1, T2.

The height adjustment elements R1, R2 have each been formed from a plastic-sand mixture in the manner which is already mentioned above and described in the European patent 3 445 734 (application number 16 71 76 67.6). However, they each have a lower sand content than the bridge beams B1, B2. In this way, the height adjustment elements R1, R2 are less brittle than the bridge beams B1, B2, such that, for example, they can be processed more easily in a material-removing manner.

The height HR of the height adjustment elements R1, R2 and thus the distance between the underside U1, U2 of the respective bridge beam B1, B2 and the upper side 10 of the support profile T1, T2 are each adjusted, for example, by milling off their upper side 11 assigned to the respective bridge beam B1, B2 such that the contact surfaces 12 each provided on the upper side of the bridge beams B1, B2 for fastening the rails S1, S2 are at an absolute target height HS predefined by the operator of the bridge, which ensures the optimal position of the running surface 13 of the rail S1, S2 for being driven over.

Figure 1:
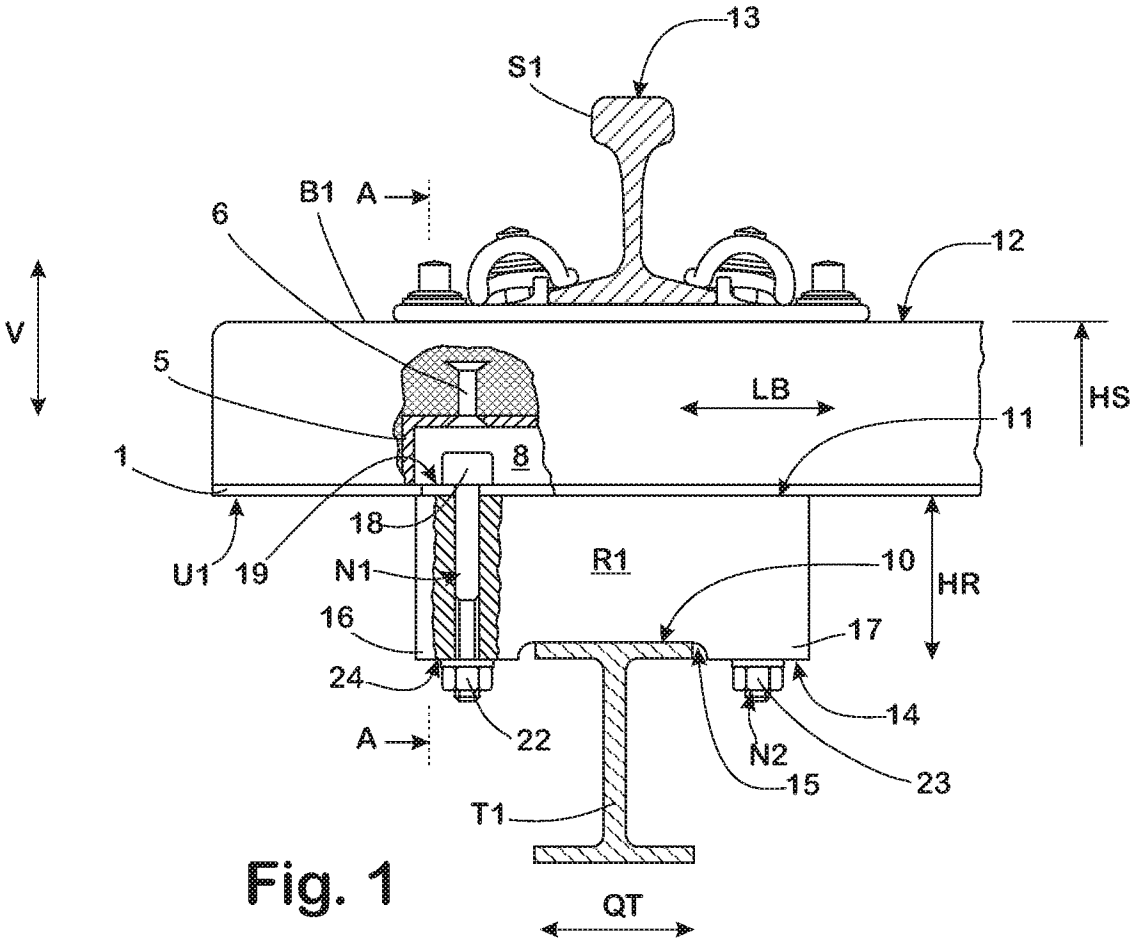
FIG. 1 the fastening of a bridge beam to a support profile of a bridge for a rail vehicle in a section transverse to the longitudinal extension of the support profile.

In the exemplary embodiment shown in FIGS. 1 and 2, a depression 15 extending in the longitudinal direction LT of the support profile T1 is formed into the underside 14 of the height adjustment element R1 and is delimited laterally by wall sections 16, 17. The width of the depression 15 is thereby dimensioned such that the support profile T1 with its upper flange sits in the depression 15 and in this case there is sufficient play between the wall sections 16, 17 and the assigned longitudinal sides of the upper flange of the support profile T1 for the height adjustment element R1 to move freely on the upper side 10 of the support profile T1. At the same time, the wall sections 16, 17 lock the height adjustment element R1 against excessive displacement in the transverse direction QT, which is aligned transversely to the longitudinal direction LT of the support profile T1.

In order to tension the height adjustment element R1 on the bridge beam B1, in the exemplary embodiment shown in FIGS. 1 and 2, two tensioning elements N1, N2 designed as tensioning screws are provided, which are each guided with their latch-like head 18 through the slot opening 9 of the retaining element H1 and are then pivoted about the longitudinal axis of the tensioning elements N1, N2 such that the head 18 is supported on the inner surface of the base plate 1 of the retaining element H1 assigned to the roof 7 of the retaining element H1 and forming a first counter bearing 19 for the tensioning elements N1, N2. With their shaft 20, the tensioning elements N1, N2 are guided through recesses 21 designed as through-openings, said recesses opening at the underside 14 of the height adjustment element H1. The nuts 22, 23 screwed onto the thread of the tensioning elements N1, N2 act against the outer surface on the underside 14 of the height adjustment element R1 forming a second counter bearing 24 for the tensioning elements N1, N2. The tensioning elements N1, N2, thus each with their heads 18 and the nuts 22, 23, form a fastening device by means of which the height adjustment element R1 is held on the bridge beam B1.

Figure 4:
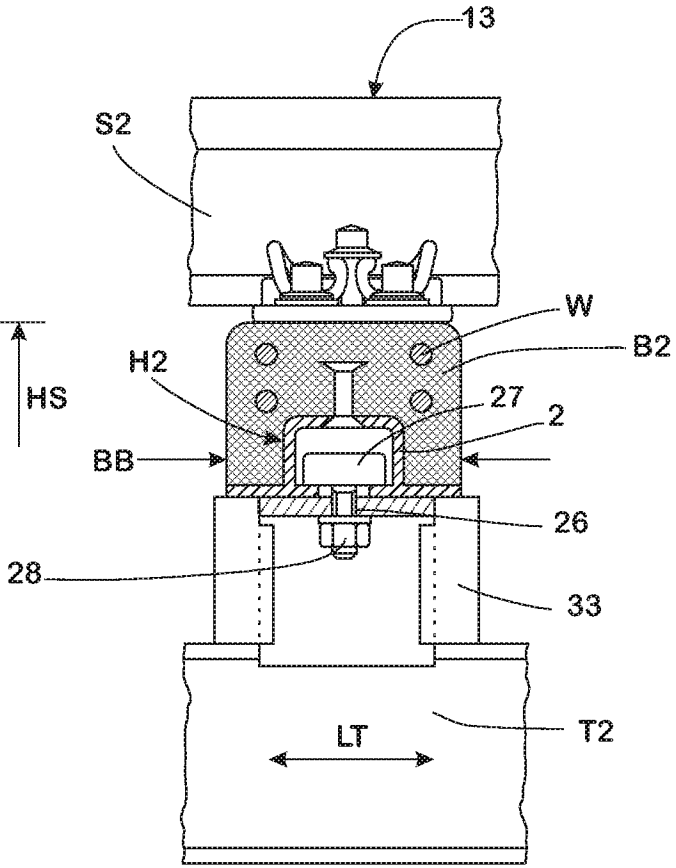
FIG. 4 the fastening according to FIG. 3 in a lateral view sectioned partially along the section line A-A drawn in FIG. 3.
Figure 3:
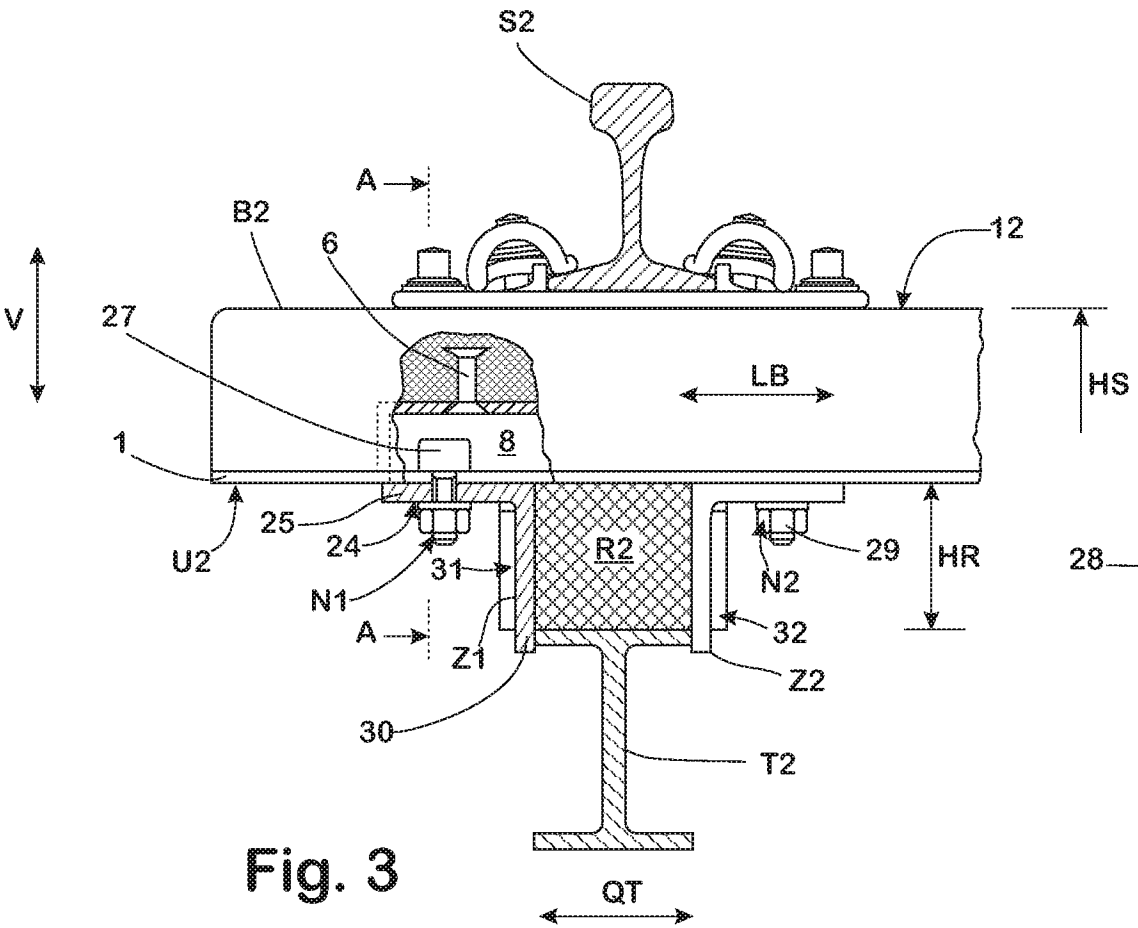
FIG. 3 an alternative fastening of a bridge beam on a support profile of a bridge for a rail vehicle in a section transverse to the longitudinal extension of the support profile.

In the exemplary embodiment shown in FIGS. 3 and 4, the bridge beam B2 is connected to the height adjustment element N2 via intermediate pieces Z1, Z2 designed as L-shaped steel angles.

The intermediate pieces Z1, Z2 lie with their one limb 25 on the underside U2 of the bridge beam B2. A recess 26 designed as a through-opening is formed into this limb 25, through which recess a tensioning means N1, N2, also designed as a tensioning screw, is guided with its shaft. The tensioning means N1, N2, like the tensioning means N1, N2 in the exemplary embodiment of FIGS. 1 and 2, each have a latch-like head 27, which is supported in the same manner as the head 18 of the tensioning elements N1, N2 on the inner surface of the base plate 1 of the retaining element H1 acting as a counter bearing 19. Accordingly, the free lower outer surface of the limb 25 also serves as a second counter bearing for the nut 28, 29, which is screwed onto the threaded shaft of the tensioning elements N1, N2. The tensioning elements N1, N2, thus with their heads 27 and the nuts 28, 29, each form a fastening device by means of which the height adjustment element R2 is held on the bridge beam B2.

In order to enable mobility of the bridge beam B2 even in the vertical direction V (direction of gravity), the second limb 30 of the intermediate pieces Z1, Z2 aligned in each case at right angles to the first limb 25 is guided in each case in a recess 31, 32, which is formed into the assigned longitudinal side surface 33 of the height adjustment element R2. The lateral boundaries of the recesses 31, 32 thereby surround the limbs 30 on their free side facing away from the height adjustment element R2, such that the limbs 30 can each be displaced exclusively in the vertical direction V in the assigned recess 31, 32. At the same time, the limbs 30 protrude beyond the underside of the height adjustment element R2 which is seated so as to be slidable on the upper flange of the support profile T2 in the longitudinal direction LT and thus form a lateral guide through which excessive movement of the height adjustment element R2 in the transverse direction QT is prevented.

REFERENCE NUMERALS

1 Base plate of the retaining elements H1, H2
2 Profile of the retaining elements H1, H2
3, 4 Limbs of the profile 2
5 Narrow side of the profile 2
6 Anchor
7 Roof of the profile 2
8 Space surrounded by the profile 2
9 Slot opening
10 Flat upper side of the upper flange of the support profiles T1, T2
11 Upper side of the height adjustment elements R1, R2
12 Contact surfaces (upper side) of the bridge beams B1, B2
13 Running surface of the rail S1, S2
14 Underside of the height adjustment element R1
15 Depression
16, 17 Wall sections
18 Head of the tensioning elements N1, N2
19 First counter bearing for the tensioning elements N1, N2
20 Shaft of the tensioning elements N1, N2
21 Recesses of the height adjustment element H1
22, 23 Nuts
24 Second counter bearing for the tensioning elements N1, N2
25, 30 Limbs of the intermediate pieces Z1, Z2
26 Recess
27 Head of the tensioning elements N1, N2
28, 29 Nuts
31, 32 Recesses
33 Longitudinal side surface of the height adjustment element H2
B1, B2 Bridge beams
BB Width of the bridge beams B1, B2
H1, H2 Retaining elements
HR Height of the height adjustment elements R1, R2
HS Absolute target height
LB Longitudinal direction of the respective bridge beams B1, B2
LT Longitudinal extension (longitudinal direction) of the support profiles T1, T2
N1, N2 Tensioning elements
QT Transverse direction of the support profiles T1, T2
R1, R2 Height adjustment elements
S1, S2 Rails
T1, T2 Support profiles
U1, U2 Underside of the bridge beams B1, B2
V Vertical direction (direction of gravity)
W Steel reinforcements
Z1, Z2 Intermediate pieces

The invention claimed is:

1. A bridge for a rail vehicle, comprising a track, which is formed from two parallel rails (S1, S2) and is provided for being driven on by the rail vehicle, and comprising a bridge beam (B1, B2), which supports the rails (S1, S2) of the track and is aligned transversely to a support profile (T1, T2) of the bridge, wherein the bridge beam (B1, B2) is supported by a height adjustment element (R1, R2) arranged between the support profile (T1, T2) and the bridge beam (B1, B2), wherein at least one fastening device is provided by means of which the position of the bridge beam (B1, B2) is fixed in relation to the height adjustment element (R1, R2), characterised in that the height adjustment element (R1, R2) is designed as a single-piece block, whose height (HR) is adapted to the distance between the support profile (T1, T2) and the bridge beam (B1, B2) by means of material-removing processing, and in that the material of which the bridge beam (B1, B2) and/or the height adjusting element (R1, R2) are made is a plastic-sand mixture, and wherein the height adjustment element (R1, R2) is mounted on the support profile (T1, T2) so as to be displaceable in the longitudinal direction (LT) of the support profile (T1, T2).

2. The bridge according to claim 1, wherein the bridge beam (B1, B2) and the height adjustment element (R1, R2) are each manufactured from a plastic-based material.

3. The bridge according to claim 1, wherein the material, from which the bridge beam (B1, B2) is manufactured, consists of 10-65% by mass of thermally deformable plastic and as the remainder of sand mixed with the plastic.

4. The bridge according to claim 2, wherein the material of the height adjustment element (R1, R2) consists of up to 65% by mass of sand and 35-100% by mass of plastic, with which, if present, the sand is mixed.

5. The bridge according to claim 3, wherein the sand content of the material, of which the height adjustment element (R1, R2) consists, is lower than the sand content of the material, of which the bridge beam (B1, B2) consists.

6. The bridge according to claim 1, wherein the height adjustment element (R1, R2) is guided so as to be displaceable on the support profile (T1, T2) in the longitudinal direction (LT) of the support profile (T1, T2).

7. The bridge according to claim 1, wherein the fastening device comprises a first counter bearing provided on the height adjustment element (R1, R2), a second counter bearing provided on the bridge beam (B1, B2) and a tensioning means (N1, N2) which braces the counter bearings against one another.

8. The bridge according to claim 7, wherein the counter bearing provided on the height adjustment element (R1, R2) is formed by an outer surface of the height adjustment element (R1, R2) on which a recess running through the height adjustment element (R1, R2) opens, through which the tensioning means (N1, N2) is guided to the counter bearing (19) of the bridge beam (B1, B2).

9. The bridge according to claim 7, wherein the counter bearing provided on the height adjustment element (R1, R2) is formed by an outer surface of an intermediate piece (Z1, Z2) held on the height adjustment element (R1, R2), on which a recess running through the height adjustment element (R1, R2) opens, through which the tensioning means (N1, N2) is guided to the counter bearing of the bridge beam (B1, B2).

10. The bridge according to claim 9, wherein the intermediate piece (Z1, Z2) is guided so as to be displaceable on the height adjustment element (R1,R2) in the direction of gravity (V).

11. The bridge according to claim 7, wherein the counter bearing of the bridge beam (B1, B2) is formed by a recess designed on the bridge beam (B1, B2) into which the tensioning means engages.

12. The bridge according to claim 11, wherein the recess is formed by a retaining element (H1, H2) cast into the bridge beam (B1, B2), which consists, at least in the region against which the tensioning means (N1, N2) acts, of a material which is more highly loadable than the material of which the bridge beam (B1, B2) consists.

13. The bridge according to claim 12, wherein the retaining element (H1, H2) is a hollow profile which has an opening directed towards an outer side of the bridge beam (B1, B2) into which the tensioning means (N1, N2) engages.

14. The bridge according to claim 12, wherein the opening of the retaining element is arranged on the underside (U1, U2) of the bridge beam (B1, B2) assigned to the support profile (T1, T2).

15. The bridge according to claim 14, wherein the opening is designed as a slot opening extending in the longitudinal direction of the bridge beam (B1, B2).

16. A method for assembling a bridge beam (B1, B2) on a support profile (T1, T2) of a bridge for a rail vehicle, provided that the upper side of the bridge beam (B1, B2) is at a certain absolute target height (HS) when fully assembled, comprising the following work steps:

a) providing a bridge beam (B1, B2);

b) providing a height adjustment element (R1, R2) manufactured as a single-piece block and having a height greater than a theoretically determined, maximum possible distance, which exists between the underside (U1, U2) of the bridge beam (B1, B2) and the upper side of the support profile (T1, T2) when the upper side (12) of the bridge beam (B1, B2) is at the target height (HS);

c) determining the actual distance present between the underside (U1, U2) of the bridge beam (B1, B2) and the upper side of the support profile (T1, T2) when the upper side of the bridge beam (B1, B2) is at the target height (HS);

d) shortening the height (HR) of the height adjustment element (R1, R2) effective in the assembly position between the underside (U1, U2) of the bridge beam (B1, B2) and the upper side of the support profile (T1, T2) by the difference determined in work step c) by means of material-removing processing of the height adjustment element (R1, R2);

e) placing the height adjustment element (R1, R2), which is adapted in terms of its height (HR), on the upper side of the support profile (T1, T2) such that the height adjustment element (R1, R2) is mounted on the support profile (T1, T2) so as to be displaceable in the longitudinal direction (LT) of the support profile (T1, T2);

f) placing the bridge beam (B1, B2) on the height adjustment element (R1, R2);

g) fixing the bridge beam (B1, B2) to the height adjustment element (R1, R2).

* * * * *